US011721909B2

(12) United States Patent
Yi

(10) Patent No.: US 11,721,909 B2
(45) Date of Patent: Aug. 8, 2023

(54) EXPANDABLE HYBRID REFLECTOR ANTENNA STRUCTURES AND ASSOCIATED COMPONENTS AND METHODS

(71) Applicant: Northrop Grumman Systems Corporation, Falls Church, VA (US)

(72) Inventor: Jack Yi, Ashburn, VA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 17/555,814

(22) Filed: Dec. 20, 2021

(65) Prior Publication Data

US 2023/0198159 A1 Jun. 22, 2023

(51) Int. Cl.
*H01Q 15/16* (2006.01)
*H01Q 1/28* (2006.01)

(52) U.S. Cl.
CPC ..... *H01Q 15/168* (2013.01); *H01Q 1/288* (2013.01)

(58) Field of Classification Search
CPC .... H01Q 15/168; H01Q 15/161; H01Q 15/20; H01Q 1/288
See application file for complete search history.

(56) References Cited

U.S. PATENT DOCUMENTS

| | | | | |
|---|---|---|---|---|
| 4,862,190 | A | 8/1989 | Palmer et al. | |
| 5,257,034 | A | 10/1993 | Turner et al. | |
| 5,680,145 | A | 10/1997 | Thomson et al. | |
| 6,028,570 | A | 2/2000 | Gilger et al. | |
| 6,104,358 | A | 8/2000 | Parker et al. | |
| 6,225,965 | B1 | 5/2001 | Gilger et al. | |
| 6,243,053 | B1 | 6/2001 | Shtarkman | |
| 6,268,835 | B1 * | 7/2001 | Toland | H01Q 3/2605 343/915 |
| 9,057,536 | B2 | 6/2015 | Lovegrove et al. | |
| 9,755,318 | B2 | 9/2017 | Mobrem et al. | |
| 2004/0017332 | A1 * | 1/2004 | Rao | H01Q 15/148 343/912 |
| 2019/0214737 | A1 * | 7/2019 | Dominocielo | H01Q 15/161 |

FOREIGN PATENT DOCUMENTS

| | | | | |
|---|---|---|---|---|
| CN | 104890900 | A * | 9/2015 | B64G 1/10 |
| CN | 108155454 | A * | 6/2018 | H01Q 1/12 |
| EP | 0184330 | A2 | 6/1986 | |
| EP | 0854537 | A3 | 7/2000 | |
| EP | 3418204 | A1 * | 12/2018 | B64G 1/007 |
| JP | 5928704 | A | 2/1984 | |

(Continued)

OTHER PUBLICATIONS

ASTROMESH® Reflector Family—Northrop Grumman Data Sheet, downloaded Nov. 29, 2021 at https://www.northropgrumman.com/space/astro-aerospace-products-astromesh/.

(Continued)

*Primary Examiner* — Hoang V Nguyen
(74) *Attorney, Agent, or Firm* — TraskBritt

(57) ABSTRACT

An antenna structure may include a solid antenna structure and a mesh antenna structure. The mesh antenna structure may be coupled to an outer edge of the solid antenna structure through two or more ribs. The two or more ribs may be configured to extend away from the solid antenna structure to expand the mesh antenna structure and increase a surface area of the antenna structure.

18 Claims, 7 Drawing Sheets

(56) References Cited

FOREIGN PATENT DOCUMENTS

| | | | | | |
|---|---|---|---|---|---|
| JP | 60-226202 | A | | 11/1985 | |
| JP | H969725 | A | * | 3/1997 | ..... H01Q 15/20 |
| RU | 2583863 | C2 | | 5/2016 | |

OTHER PUBLICATIONS

The European Space Agency (ESA)—Mesh reflector for shaped radio beams, Downloaded Nov. 29, 2021 at https://www.esa.int/ESA_Multimedia/Images/2020/09/Mesh_reflector_for_shaped_radio_beams.

International Search Report for International Application No. PCT/US2022/081557, dated Mar. 20, 2023, 5 pages.

International Written Opinion for International Application No. PCT/US2022/081557, dated Mar. 20, 2023, 10 pages.

* cited by examiner

EXPANDABLE HYBRID REFLECTOR ANTENNA STRUCTURES AND ASSOCIATED COMPONENTS AND METHODS

TECHNICAL FIELD

Embodiments of the disclosure generally relate to hybrid reflector antenna structures. In particular, embodiments of the disclosure relate to expandable hybrid reflector antenna structures and associated components and methods.

BACKGROUND

Reflectors for concentrating radio frequency (RF) radiation are employed in a variety of antennas installed in spacecraft or mounted on the ground. The reflector of an antenna may cause the radiated power to be contained in a main lobe of the radiation pattern of the antenna, rather than side lobes of the antenna. Accordingly, reflector antennas may have a paraboloidal or shaped surface profile to intercept incoming radio or optical waves and reflect the waves to a feed at a common focal point.

Satellite and communications technologies often require that space-based devices and other high technology machinery be lightweight yet durable to withstand the effects of the space environment. Such devices, however, must also be practically devised to be launched from Earth in a small package and deployed in space autonomously. For example, a vehicle intended to be launched into space may have payload limitations, such as cross-sectional limitations and weight limitations to accommodate the launch vehicle, such as a rocket. The effectiveness of an antenna may be associated with a surface area of the antenna. For example, increasing a surface area of an antenna may increase the quality and/or coverage of signals received by and/or transmitted from the antenna. An expandable antenna may be stowed in a small space during transportation and may be expanded to form an antenna with a larger surface area when deployed.

BRIEF SUMMARY

Embodiments of the disclosure may include an antenna structure. The antenna structure may include a solid antenna structure and a mesh antenna structure. The mesh antenna structure may be coupled to an outer edge of the solid antenna structure through two or more ribs. The one or more ribs may be configured to extend away from the solid antenna structure to expand the mesh of the antenna structure and increase a surface area of the antenna structure.

Other embodiments of the disclosure may include a reflector antenna cluster mounted on a common backing structure. The cluster may include at least two antennas. Each of the at least two antennas may include a solid central antenna portion and one or more mesh portions. The one or more mesh portions may be coupled to the solid central antenna portion through two or more ribs. The two or more ribs may be configured to apply a tension to the one or more mesh panels in an expanded form.

Other embodiments of the disclosure may include a method of deploying an antenna assembly. The method may include providing an antenna assembly in a retracted configuration. The antenna assembly may include a solid antenna structure and mesh antenna structures coupled to the solid antenna structure. The method may further include releasing a retaining mechanism. The retaining mechanism may secure two or more ribs of the mesh antenna structures to the solid antenna structure in the retracted configuration. The method may further include rotating the two or more ribs about a hinged connection to an expanded configuration. The method may also include applying tension to one or more mesh panels of the mesh antenna structures coupled between the two or more ribs when the two or more ribs rotate about the hinged connection to the expanded configuration.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
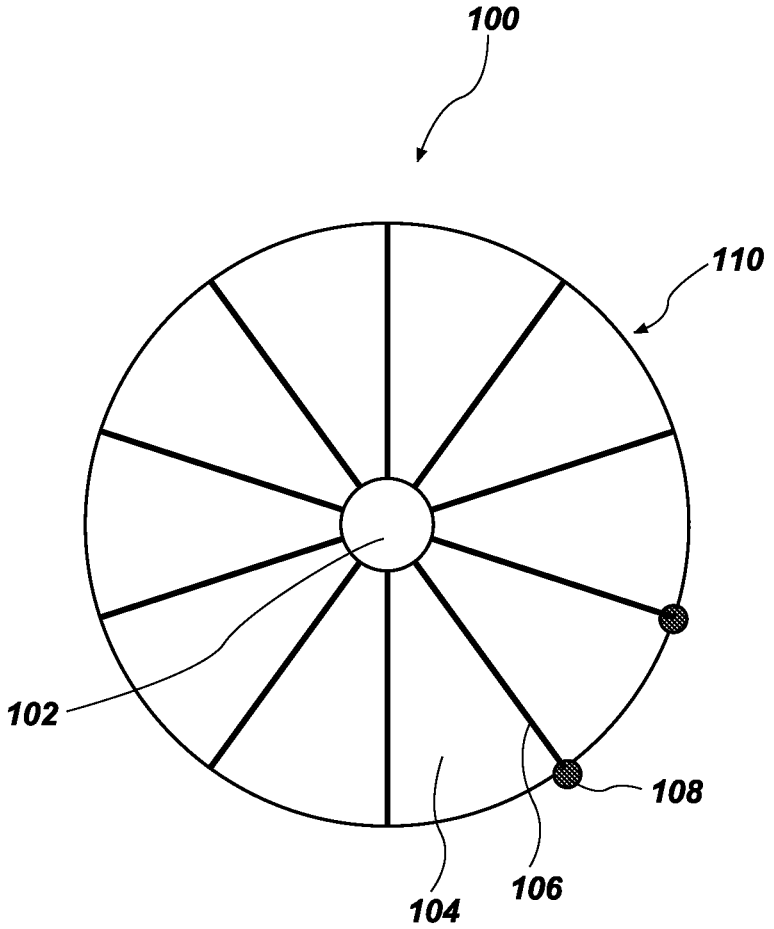
FIG. 1 illustrates a planar view of an antenna in a retracted configuration in accordance with embodiments of the disclosure.

The following description provides specific details, such as material compositions, shapes, and sizes, in order to provide a thorough description of embodiments of the disclosure. However, a person of ordinary skill in the art would understand that the embodiments of the disclosure may be practiced without employing these specific details. Indeed, the embodiments of the disclosure may be practiced in conjunction with conventional techniques employed in the industry.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough (e.g., non-planar) and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "configured" and "configuration" refers to a size, a shape, a material composition, a material distribution, orientation, and arrangement of at least one feature (e.g., one or more of at least one structure, at least one material, at least one region, at least one device) facilitating use of the at least one feature in a pre-determined way.

As used herein, the term "substantially" in reference to a given parameter means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, relational terms, such as "beneath," "below," "lower," "bottom," "above," "upper," "top," "front," "rear," "left," "right," and the like, may be used for ease of description to describe one element's or feature's relationship to another element(s) or feature(s) as illustrated in the drawings. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" means and includes any and all combinations of one or more of the associated listed items.

As used herein, the terms "vertical," "longitudinal," "horizontal," and "lateral" are in reference to a major plane of a structure and are not necessarily defined by earth's gravitational field. A "horizontal" or "lateral" direction is a direction that is substantially parallel to the major plane of the structure, while a "vertical" or "longitudinal" direction is a direction that is substantially perpendicular to the major plane of the structure. The major plane of the structure is defined by a surface of the structure having a relatively large area compared to other surfaces of the structure. With reference to the drawings, a "horizontal" or "lateral" direction may be perpendicular to an indicated "Z" axis, and may be parallel to an indicated "X" axis and/or parallel to an indicated "Y" axis; and a "vertical" or "longitudinal" direction may be parallel to an indicated "Z" axis, may be perpendicular to an indicated "X" axis, and may be perpendicular to an indicated "Y" axis.

As described above, antennas may be expandable, such that the antenna may be stored in a small volume (e.g., space) of an aerospace vehicle during transportation to space and may expand to form an antenna with a larger surface area when deployed. Conventional expandable antennas are formed from an entire mesh structure, such as a knitted gold-plated molybdenum wire mesh unfurlable reflector antenna. The mesh antennas may be complex and expensive, often costing several million dollars. Furthermore, conventional mesh antennas have less surface accuracy (e.g., irregular surface topography, such as sagging or pillowing) than solid antennas, which may reduce signal effectiveness and increase power usage or consumption. Creating an antenna according to embodiments of the disclosure having both a solid reflector portion and one or more expandable reflector portions (e.g., an expandable mesh reflector portions) may reduce the overall cost of the antenna and increase the effectiveness and power efficiency of the antenna by increasing a surface area of the reflector portions of the antenna and increasing overall surface accuracy of the antenna. The solid reflector portion may also serve dual purposes of a hub for stowage of the mesh reflector portion and a radiating element after the mesh deployment. After launch of the vehicle, the expandable reflector portion of the antenna according to embodiments of the disclosure may be deployed from a retracted configuration to an expanded configuration.

FIG. 1 illustrates an antenna 100 in a retracted configuration. The antenna 100 may include a solid central panel 102 and multiple mesh panels 104 coupled to the solid panel 102. In the retracted configuration of FIG. 1, the mesh panels 104 may lie within the footprint of the solid panel 102. In other words, the mesh panels 104 may be folded over or under the solid panel 102, such that the mesh panels 104 are contained within a perimeter 110 of the solid panel 102. As illustrated in FIG. 1, the antenna 100 may be substantially circular. However, in other embodiments, the antenna 100 may have another polygonal shape, such as triangular, square, rectangular, etc. Dimensions of the perimeter 110 of the solid panel 102 may be selected based on the available storage space (e.g., stowage space) for the antenna 100 on the vehicle. For example, a spacecraft having a five (5) meter fairing may provide storage space for a solid antenna having a major dimension (e.g., diameter, length, height, apothem, etc.) of less than about 2.6 meters with the mesh panels 104 folded over or under the solid panel 102 to fit within the storage space.

The solid panel 102 may be formed from radiofrequency-reflective material that is thermally stable (e.g., does not exhibit significant thermally induced changes in surface profile) at temperatures commonly experienced in space, such as temperatures between about 173 K (e.g., about −100° C., about −148° F.) and about 393 K (e.g., about 120° C., about 248° F.). For example, the solid panel 102 may be formed from a material such as graphite or aluminum. The solid panel 102 may be configured to reflect radio waves. The solid panel 102 may be formed by conventional techniques.

The mesh panels 104 may be formed from a conductive mesh configured to reflect radiofrequency waves. The conductive mesh may, for example, be a knitted fabric that is lightweight, yet strong to form a smooth, substantially flat (e.g., planar) or curved surface when tension is applied to the mesh panels 104 by ribs 106. For example, the conductive mesh may be a warp-knitted gold-plated molybdenum wire. The mesh panels 104 may be configured to expand following launch of the vehicle.

The mesh panels 104 may be coupled to the ribs 106. The ribs 106 may extend along a length of the mesh panels 104. The ribs 106 may be coupled to the solid panel 102 through hinged connections 108 positioned about the perimeter 110 of the solid panel 102. In some embodiments, the hinged connections 108 may be spring loaded hinges. For example, the hinged connection 108 may include a biasing element, such as a spring (e.g., torsion spring, leaf spring, compression spring, etc.) that biases the hinged connection 108 to an expanded (e.g., extended) position. Thus, the hinged connections 108 may drive the mesh panels 104 to the extended position illustrated in FIG. 2 and described in further detail below. In the retracted configuration illustrated in FIG. 1, the ribs 106 may be held in place in the retracted configuration. For example, a latch or strap may retain the ribs 106 and the mesh panels 104 in the retracted configuration. When the antenna 100 is deployed, the latch or strap may be released, such that the hinged connections 108 may extend the ribs 106 and the mesh panels 104 to the expanded position. The ribs 106 may extend in a synchronized or sequential manner. For example, in some embodiments, each of the ribs 106 may extend at substantially the same time. In other embodiments, each rib 106 may begin extending at an individual time distinct from the adjacent ribs 106. The ribs 106 may extend in a sequence or order, such that the ribs 106 progressively extend around the perimeter 110 of the solid panel 102 until each of the ribs 106 are extending. In other embodiments, the some of the ribs 106 may extend at substantially the same time while the extension of other ribs 106 may be delayed.

Figure 2:
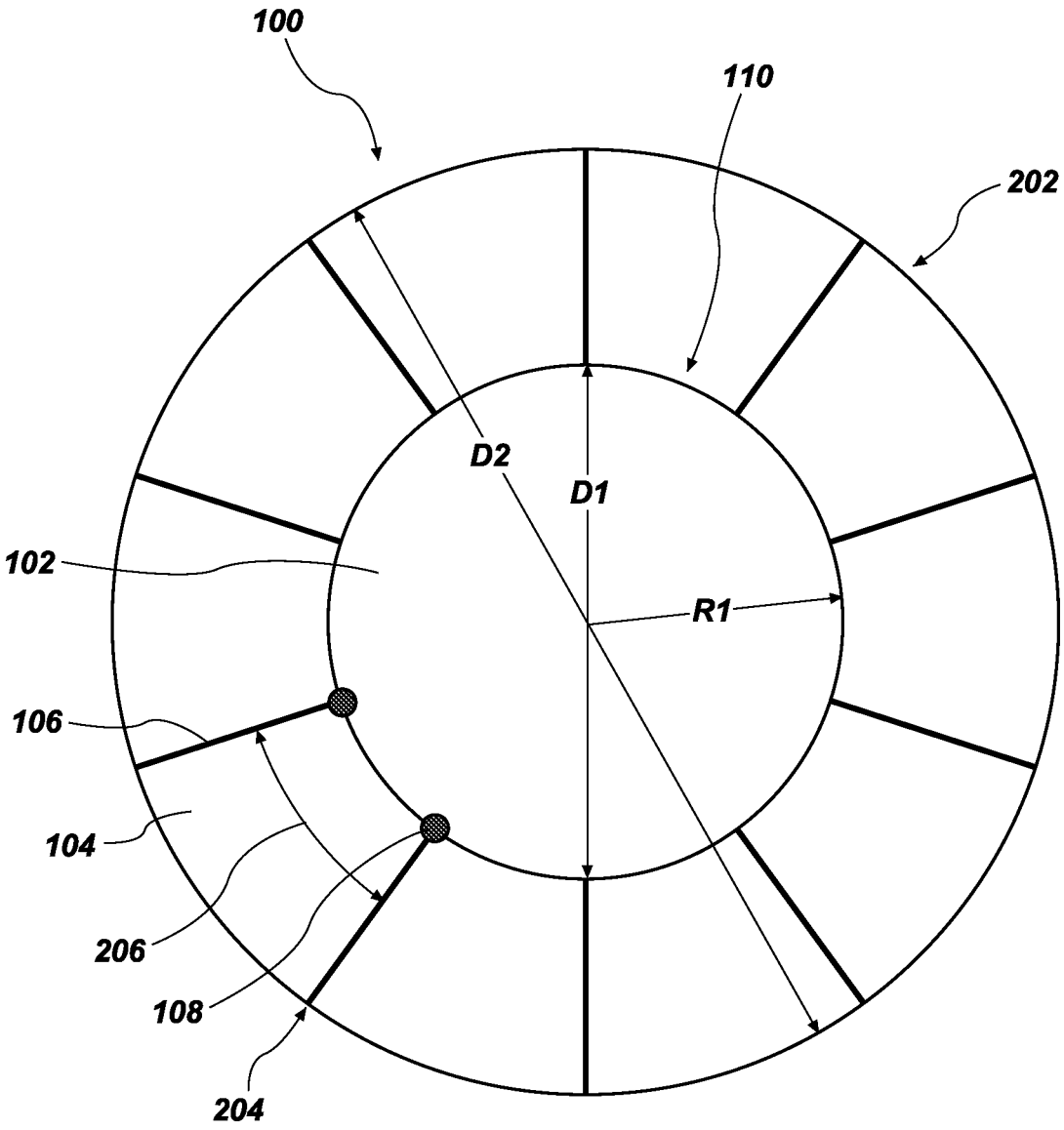
FIG. 2 illustrates a planar view of the antenna of FIG. 1 in an expanded configuration in accordance with embodiments of the disclosure.

FIG. 2 illustrates the antenna 100 in the expanded position. In the expanded positioned, the mesh panels 104 may form a circular disk around the perimeter 110 of the solid panel 102, such that the solid panel 102 forms a hub to secure the mesh panels 104. The circular disk formed from the expanded mesh panels 104 may have a greater outer diameter than the solid panel 102. The mesh panels 104 may be supported by the ribs 106. The mesh panels 104 may be stretched laterally between adjacent ribs 106, such that the mesh panels 104 between the adjacent ribs 106 are substantially flat (e.g., planar) in the expanded position. By forming the hub, the solid panel 102 effectively shortens the length of the ribs 106 to achieve a similar final diameter relative to a conventional mesh antenna. Shortening the length of the ribs 106 may reduce the area spanned by the mesh panels 104, which may increase the surface accuracy of the mesh panels 104.

In some embodiments, the ribs 106 may have a profile or shape configured to increase the tension in each of the mesh panels 104. In some embodiments, the ribs 106 may be formed from a flexible material configured to substantially balance a tensile force throughout the mesh panels 104, such that the tensile forces in each of the mesh panels 104 is substantially the same. The ribs 106 may be formed through an additive manufacturing process, such as a three-dimensional (3-D) printing process, such that the profile, shape or cross-sectional areas of the ribs 106 and longitudinally spaced rib portions may be controlled, as well as the flexibility of the ribs 106. However, the ribs 106 may be formed by conventional techniques. For example, the ribs 106 may be formed to have regions that are more flexible than other regions to maintain substantially constant tension in the mesh panels 104 when deployed. Maintaining tension in the mesh panels 104 may substantially limit non-planar features, such as sagging, pillowing, etc., of the mesh panels 104 between the ribs 106. Thus, the conductive mesh of the mesh panels 104 may form a substantially piecewise flat reflective surface around the outer perimeter 110 of the solid panel 102.

The ribs 106 may be formed from a strong flexible material, such as a composite material (e.g., carbon fiber, fiber glass, etc.) or a metal material (e.g., aluminum).

The mesh panels 104 may form an extension of the reflective surface of the solid panel 102, effectively increasing a total diameter D2 of the antenna 100. For example, the total diameter D2 of the antenna 100 may be the diameter D1 of the solid panel 102 plus the length of two of the ribs 106. If the ribs 106 have a length that is substantially equal to a radius R1 of the solid panel 102, the mesh panels 104 may effectively double or nearly double the diameter D1 of the solid panel 102.

Figure 3:
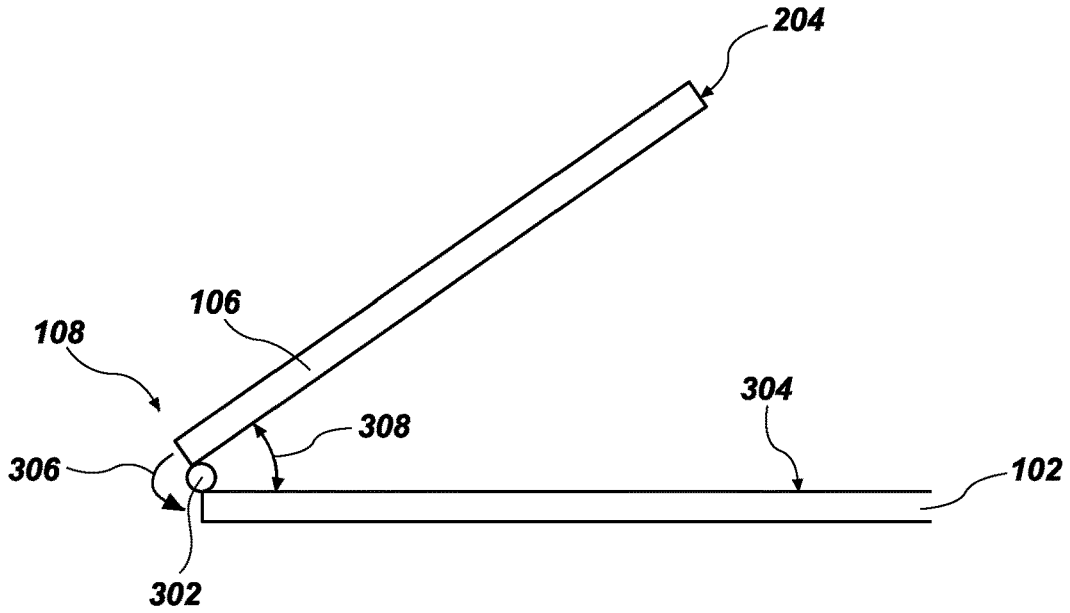
FIG. 3 illustrates a schematic view of a hinged connection between components of an antenna in accordance with embodiments of the disclosure.
Figure 4:
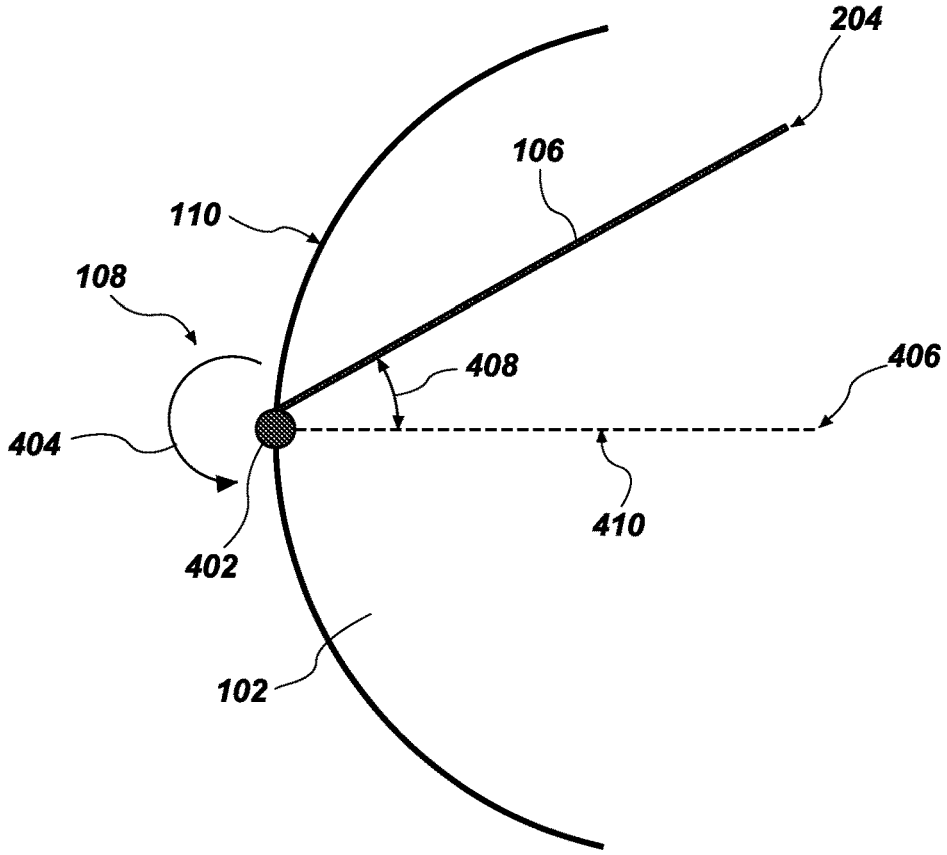
FIG. 4 illustrates a schematic view of a hinged connection between components of an antenna in accordance with embodiments of the disclosure.

As described above, the ribs 106 may extend to form the extension of the reflective surface of the solid panel 102 by rotating about the hinged connections 108 between the ribs 106 and the perimeter 110 of the solid panel 102. FIG. 3 and FIG. 4 illustrate embodiments of the hinged connections 108. Because the hinged connections 108 are positioned radially about the perimeter 110 of the solid panel 102, the ribs 106 may extend away from the solid panel 102 at angles 206 (see FIG. 2) relative to the adjacent ribs 106. The angles 206 between the adjacent ribs 106 will cause an outer edge 204 (e.g., distal portion of the ribs 106) of the adjacent ribs 106 to be a greater distance apart than the end of the adjacent ribs 106 coupled to the solid panel 102 (e.g., proximal portion of the ribs 106) through the hinged connections 108. The distance between the outer edges 204 of the adjacent ribs 106 may increase as the ribs 106 are extended, such that the tension in the mesh panels 104 may increase as the ribs 106 are extended. Thus, the mesh panels 104 may be substantially free of tension forces in the retracted configuration illustrated in FIG. 1 and may have the maximum amount of tension applied through the ribs 106 when in the fully extended configuration illustrated in FIG. 2.

The antenna 100 may have the same number of mesh panels 104 as ribs 106, such that each mesh panel 104 is coupled to at least two ribs 106 and each rib 106 is coupled to at least two mesh panels 104. Increasing the number of mesh panels 104 and ribs 106 may substantially reduce a span that each mesh panel 104 covers. Reducing the span may reduce the pillowing or sagging in the mesh panels 104 between the ribs 106. For example, the number of ribs 106 and mesh panels 104 on an antenna 100 may range from four ribs 106 and four mesh panels 104 to thirty ribs 106 and thirty mesh panels 104, such as from eight ribs 106 and eight mesh panels 104 to twenty ribs 106 and twenty mesh panels 104, or ten ribs 106 and ten mesh panels 104.

FIG. 3 illustrates an embodiment of the hinged connection 108 between a rib 106 and the solid panel 102. The hinged connection 108 may include a hinge 302 coupled between the rib 106 and the solid panel 102. The hinge 302 may be configured and/or positioned to allow the rib 106 to rotate relative to the solid panel 102 in a plane perpendicular to the plane of the solid panel 102. For example, the rib 106 may initially be positioned against a surface 304 of the solid panel 102. The rib 106 may be substantially parallel to the surface 304 of the solid panel 102. As the rib 106 rotates about the hinge 302, the rib 106 may rotate away from the surface 304 of the solid panel 102, such that the rib 106 is no longer parallel to the surface 304 of the solid panel 102.

As described above, the hinge 302 may include a biasing element, such as a spring. The biasing element may generate a rotational force in the hinge 302 in the direction of the arrow 306 illustrated in FIG. 3. The rotational force in the hinge 302 generated by the biasing element may lift the rib 106 off the surface 304 of the solid panel 102 and rotate the rib 106 away from the surface 304 of the solid panel 102. The biasing element may cause the rib 106 to rotate until the rib 106 is again substantially parallel to the surface 304 of the solid panel 102, approximately 180° from the starting (e.g., retracted) position. In some embodiments, the tension in the mesh panels 104 may be substantially the same as the rotational force of the biasing element before the rib 106 reaches the substantially parallel position, such that the rib 106 may stop rotating. For example, the rib 106 may stop rotating or be in a final resting position at an angle 308 in a range of from about 90° to about 180°, such as from about 135° to about 180°, or from about 150° to about 180°.

FIG. 4 illustrates another embodiment of a hinged connection 108 between the rib 106 and the solid panel 102. The hinged connection 108 may include a hinge 402 coupling the rib 106 to the solid panel 102. The hinge 402 may be configured and/or arranged to allow the rib 106 to rotate in a plane substantially parallel to the plane of the solid panel 102. For example, in a starting position 410 (e.g., retracted position, indicated by the dashed line) the rib 106 may be positioned to form a line between the hinge 402 on a perimeter 110 of the solid panel 102 and a central region 406 of the solid panel 102. The rib 106 may then rotate in the plane substantially parallel to the plane of the solid panel 102, such that an angle between the rib 106 and a surface of the solid panel 102 remains at substantially 0° throughout the rotation of the rib 106. As the rib 106 rotates, an angle 408 between the rib 106 and the starting position 410 may increase, such that a distance between the outer edge 204 of the rib 106 and the central region 406 of the solid panel 102 may increase. The rib 106 may rotate about the hinge 402 until the angle 408 between the rib 106 and the starting position 410 is between about 200° and about 160°, such as about 180°.

As described above, the hinge 402 may include a biasing element, such as a spring. The biasing element may generate a rotational force in the hinge 402 in the direction of the arrow 404 illustrated in FIG. 4. The rotational force in the hinge 402 generated by the biasing element may rotate the rib 106 across the surface of the solid panel 102 and rotate the rib 106 away from the starting position 410 of the rib 106. The biasing element may cause the rib 106 to rotate until the angle 408 between the rib 106 and the starting position 410 of the rib 106 is approximately 180°.

As described above, the ribs 106 may be formed from a flexible material, such that the ribs may flex or bend to balance the tension within the mesh panels 104. Thus, as described above with respect to the hinge 302, the tension within the mesh panels 104 may substantially prevent the outer edges 204 of the ribs 106 from remaining in a plane substantially parallel to the plane of the solid panel 102. The flexible material of the ribs 106 may allow the ribs 106 to flex or bend to form an angle that maintains the desired tension in the mesh panels 104.

In some embodiments, the ribs 106 may extend past the central region 406 of the solid panel 102 when in the starting position 410. For example, the ribs 106 may have a length that is greater than a minor dimension (e.g., radius) of the solid panel 102, such that the ribs 106 extend from the perimeter 110 of the solid panel 102 past the central region 406 of the solid panel 102. In such an embodiment, when in the extended position the ribs 106 may extend the antenna 100 (FIG. 2) to greater than twice the size of the solid panel 102. For example, the final diameter of the antenna 100 may be in the range of from about two times the diameter of the solid panel 102 to about four times the diameter of the solid panel 102, such as from about two times the diameter of the solid panel 102 to about three times the diameter of the solid panel 102.

Figure 5:
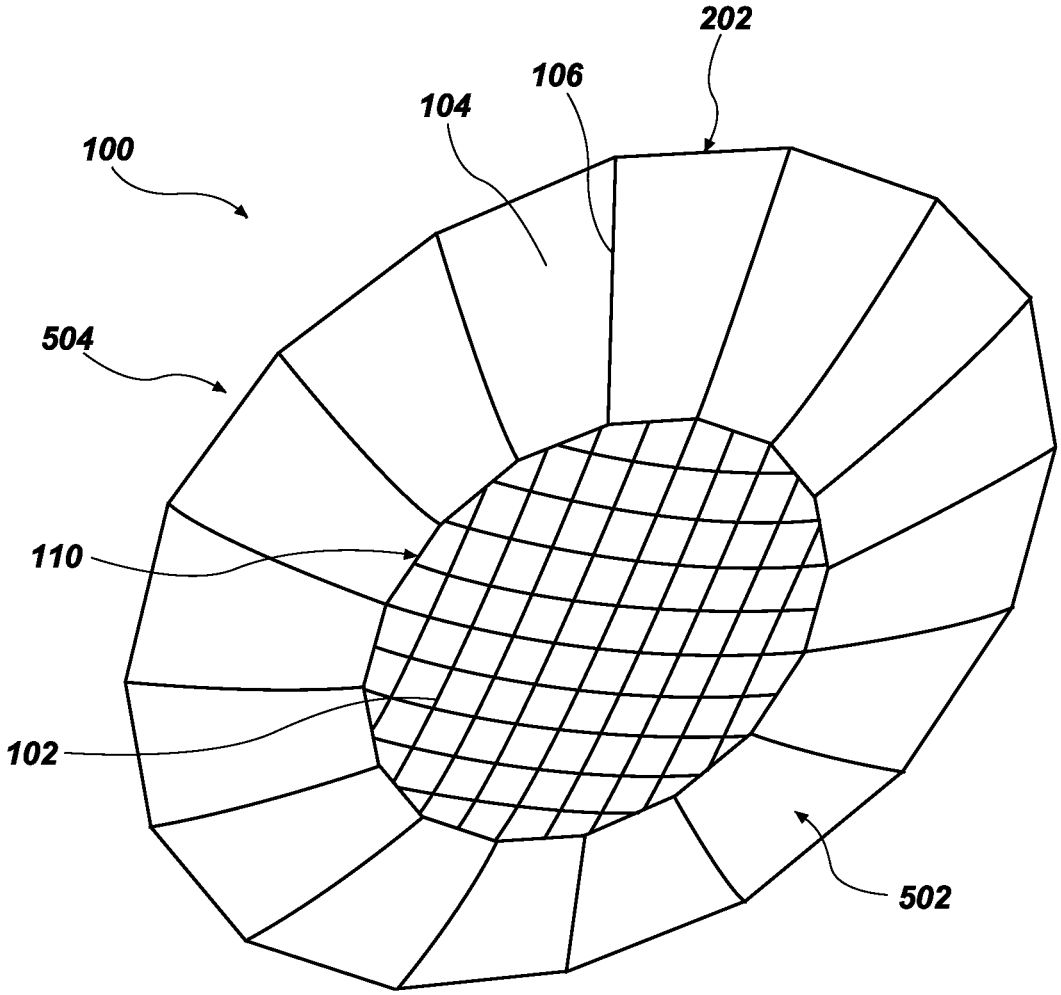
FIG. 5 illustrates a perspective view of the antenna of FIGS. 1 and 2 in accordance with embodiments of the disclosure.

FIG. 5 illustrates a view of the antenna 100 in the expanded configuration. As described above, the tension in the mesh panels 104 may stop the expansion of the ribs 106 before the ribs 106 are extended at a full 180° relative to the surface of the solid panel 102 or may cause flexible ribs 106 to deform or flex to maintain the tension in the mesh panels 104. Thus, the tension in the mesh panels 104 may cause the antenna 100 to have a dished shape (e.g., a frustoconical, a parabolic or a shaped surface profile, etc.). As described above, the solid panel 102 may be substantially planar (e.g., flat) in the expanded configuration, such that the dished shape is formed by the mesh panels 104 extending from the solid panel 102. In some embodiments, the solid panel 102 may be dished (e.g., a face of the solid panel 102 may be rounded, parabolic, etc.) to form the dished shape. The outer disk formed by the mesh panels 104 may form a conical shape surrounding the solid panel 102, such that the final shape of the antenna is the dished or frustoconical shape. The ribs 106 and/or hinged connections 108 may be arranged, such that a front side 502 of the antenna 100 exhibits a concave shape and a rear side 504 of the antenna 100 exhibits a convex shape.

In some embodiments, the ribs 106 may be configured and/or shaped to control a shape of the expanded antenna 100. For example, the ribs 106 may be configured to form a specific angle between the ribs 106 and the solid panel 102. In another example, the ribs 106 may cause the mesh panels 104 to form a curved surface extending between the perimeter 110 of the solid panel 102 and the outer perimeter 202 of the antenna 100. Changing the shape of the mesh panels 104 when the antenna 100 is in the expanded configuration may change the manner in which the radio or optical waves are reflected off of the reflector of the antenna 100. For example, the reflected radio or optical waves may form a beam leaving the antenna 100 and changing the shape of the mesh panels 104 may change a shape of the reflected beam. Thus, the design of the ribs 106 may allow the beam shape reflected from the antenna 100 to be customized (e.g., tailored) for specific applications.

Figure 8:
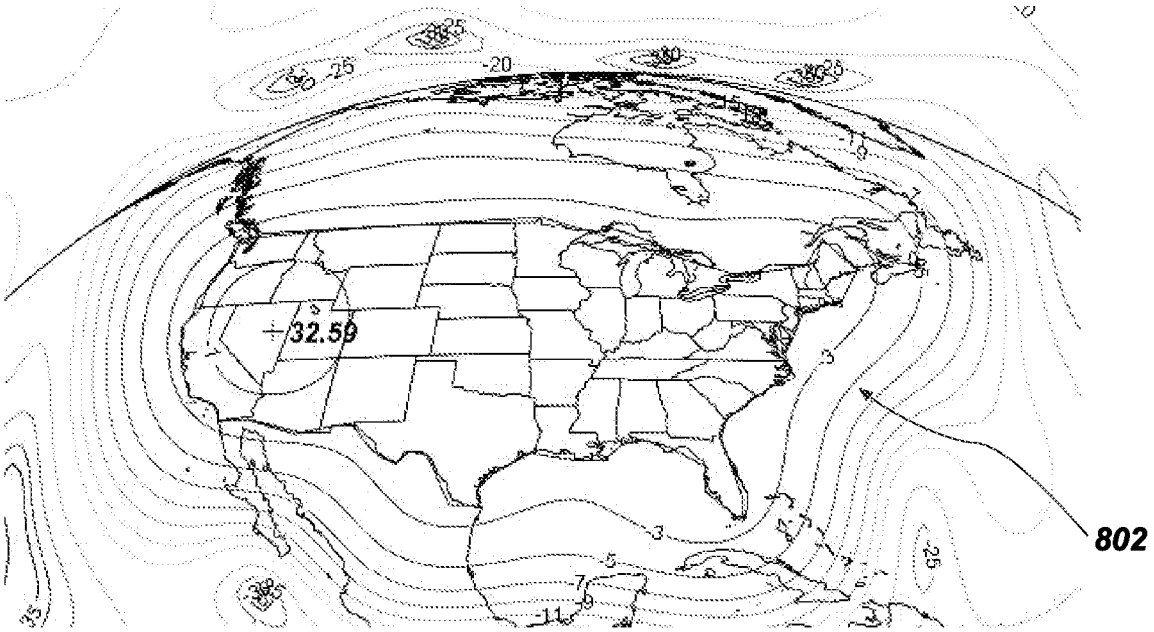
FIG. 8 illustrates a simulated antenna contoured pattern generated from a conventional solid reflector antenna.
Figure 9:
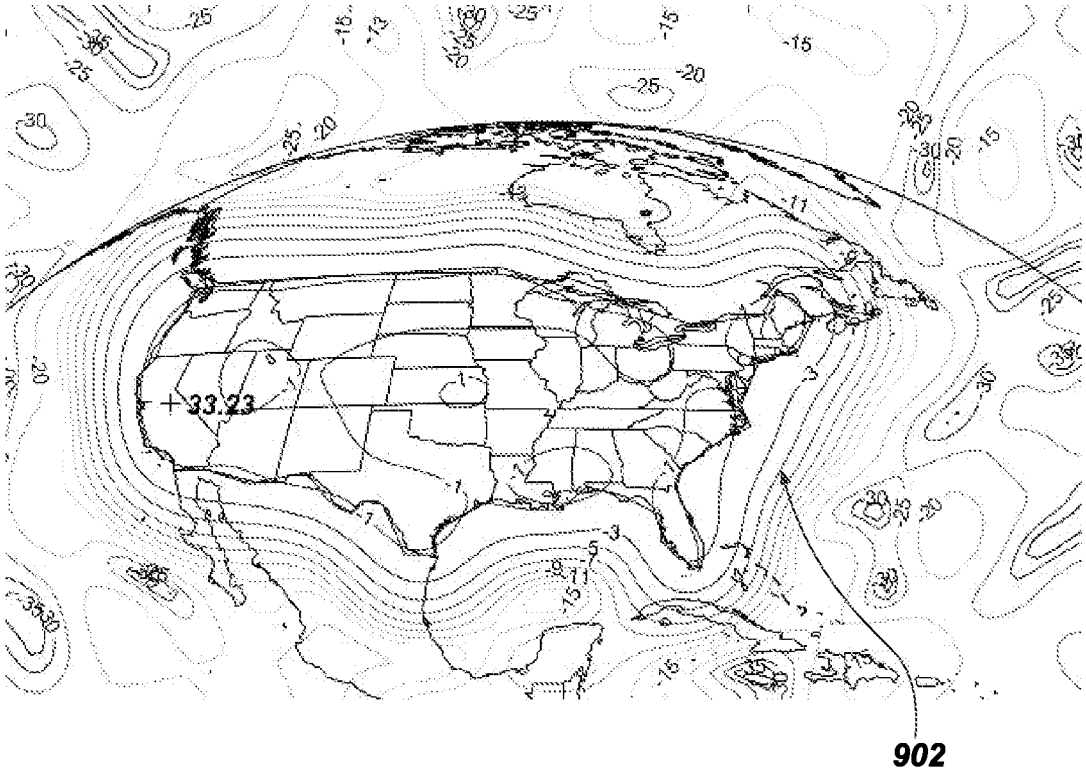
FIG. 9 illustrates a simulated antenna contoured pattern generated from a reflector antenna in accordance with embodiments of the disclosure.

During use and operation, the antenna 100 may provide a wide beam area for an incoming or outgoing signal, which beam may target a relatively large region, such as a continent, larger countries, the continental United States, etc. The hybrid reflector construction of the antenna 100 (e.g., the combination of a solid panel and multiple mesh panels) may improve the surface accuracy of the antenna 100 relative to conventional antennas formed entirely from mesh materials while also allowing the antenna 100 to expand to a size (e.g., major dimension, diameter, etc.) greater than the maximum allowable solid antenna size for the deploying vehicle. Thus, the antenna 100 may be larger, when deployed, compared to conventional solid antennas increasing the target region while simultaneously having greater surface accuracy which may reduce the power consumption of the antenna 100. Spacecraft may have limited power available due to the weight of power storage devices, such as batteries, and the space required for power generation (e.g., solar panels). Thus, reducing the power consumption of an antenna may make additional power available for other operations and/or equipment on the spacecraft. As an example, FIG. 8 illustrates a simulated beam pattern 802 for a C-band CONUS (Continental United States) coverage served by a contoured antenna pattern from a 2.7-meter conventional solid shaped reflector and FIG. 9 illustrates a simulated beam pattern 902 for a C-band CONUS coverage served by a 5.4-meter hybrid reflector antenna in an expanded configuration in accordance with embodiments of the disclosure. The contoured beam patterns 802, 902 may be characterized by how closely they follow the perimeter of the target area, which in the case of FIGS. 8 and 9 is the Continental United States. As illustrated in FIG. 9, the hybrid reflector antenna produces a well-tailored contoured beam pattern that substantially follows the perimeter of the Continental United States. The well-tailored contoured beam pattern results in an improvement of EoC (edge-of coverage) antenna gain by about 2 dB or an equivalent of power saving of about 60% over the conventional 2.7 meter conventional reflector.

Figure 6:
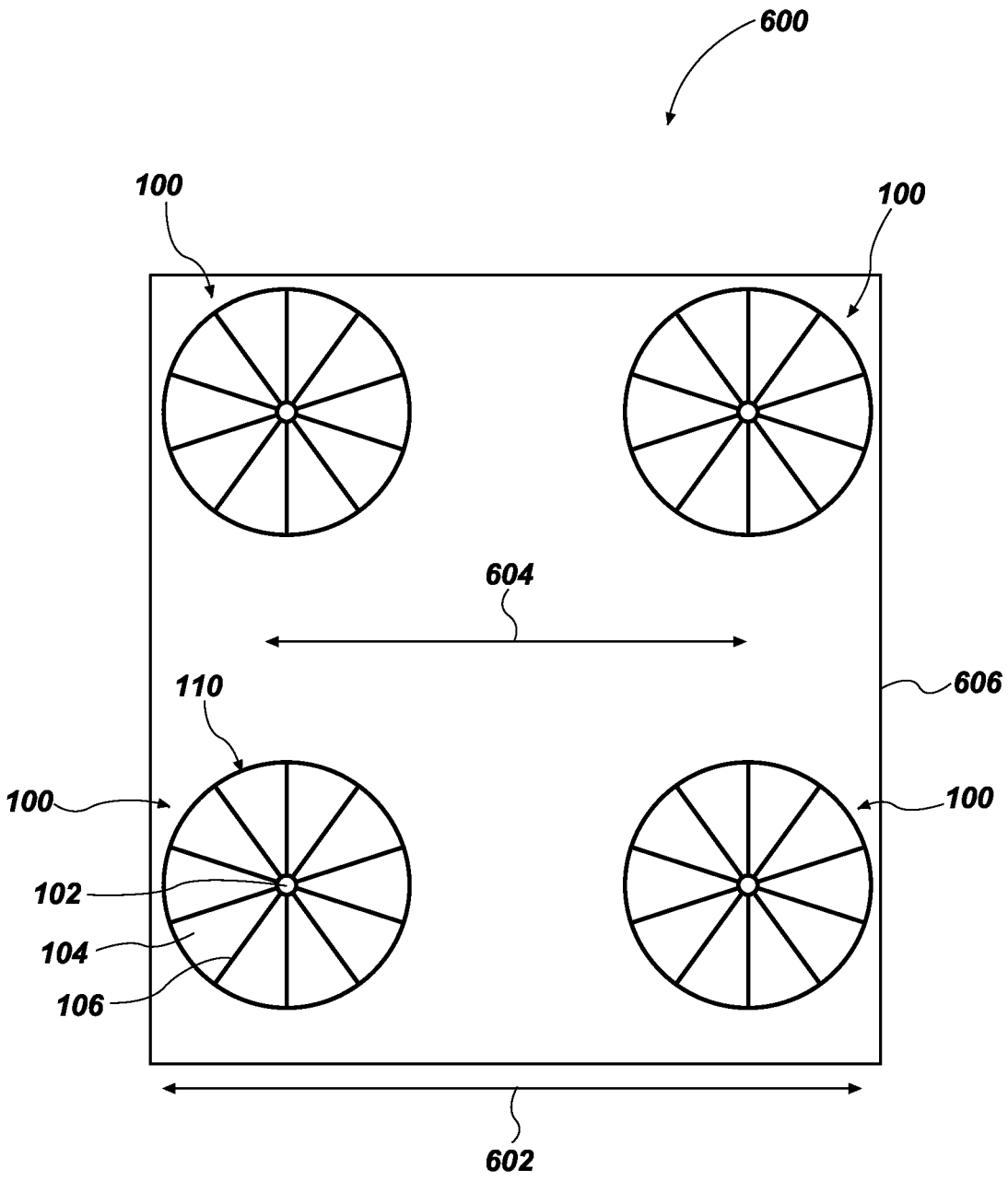
FIG. 6 illustrates a planar view of a cluster of antennas in a retracted configuration in accordance with embodiments of the disclosure.

Referring now to FIG. 6, in some embodiments, an aerospace vehicle may be configured to carry a cluster 600 of multiple antennas 100. As described above, the vehicle may have storage constraints, such as dimensional limitations 602 of a storage area 606 of the vehicle. Thus, in the retracted configuration, all of the antennas 100 in the cluster 600 may be sized and arranged to fit within the dimensional limitations 602. For example, when the antennas 100 are in the retracted configuration, the perimeter 110 of each of the retracted antennas 100 or the perimeter 110 of the solid panels 102 of the antennas 100 may not extend outside the dimensional limitations 602 of the storage area 606 of the vehicle. As described above, the area available for storing the antennas 100 in a conventional spacecraft, such as a satellite, may be defined by the size of the vehicle fairing. For example, a 5 meter fairing may provide a dimensional limitation 602 of between about 2.5 meters and about 3 meters, such as about 2.85 meters.

Each antenna 100 of the cluster 600 may also be positioned relative to the other antennas 100 in the cluster 600 so as to accommodate the expansion of each antenna 100. For example, the spacing 604 between the central regions 406 of each of the antennas 100 may be sufficient to allow each antenna 100 to fully expand without contacting an adjacent antenna 100. The spacing 604 between the central regions 406 of adjacent antennas 100 may be at least equivalent to a final major dimension (e.g., diameter, width, apothem, etc.) of the associated antennas 100. For example, if each antenna 100 in a deployed or expanded configuration, as illustrated in FIG. 7, is about 2 meters, the spacing 604 between the central regions 406 of the adjacent antennas 100 may be at least about 2 meters, such that each antenna 100 is provided with sufficient space to expand to a minor dimension (e.g., radius) of less than about 1 meter without contacting the adjacent expanded antenna 100.

Figure 7:
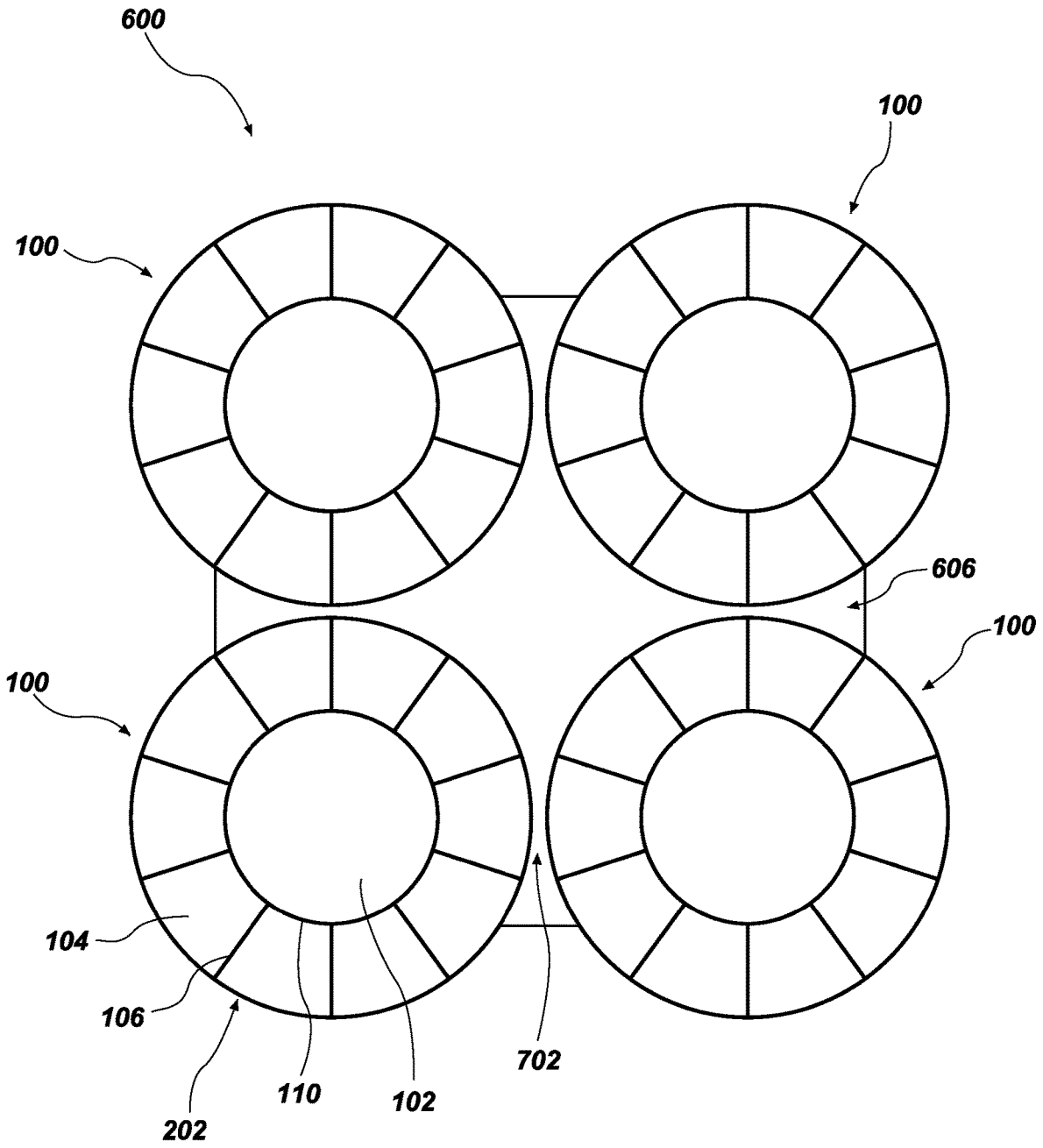
FIG. 7 illustrates a planar view of a cluster of antennas of FIG. 6 in an expanded configuration in accordance with embodiments of the disclosure.

FIG. 7 illustrates the cluster 600 of antennas 100 with the antennas 100 in the expanded or deployed configuration. When deployed, the perimeter 202 of each of the antennas 100 defined by the mesh panels 104 may extend beyond the confines of the storage area 606 of the vehicle. The spacing 604 between the antennas 100 of the cluster 600 may provide a clearance 702 between the perimeters 202 of adjacent antennas 100, such that the expanded or deployed antennas 100 do not interfere with one another.

During use and operation, the cluster 600 of antenna 100 may enable multiple spot beams to be provided from a single vehicle. Spot beams may be a targeted radio signal directed to or emanating from a specific region, such as a specific state in the United States, a specific smaller country in Europe, etc. Providing multiple spot beams on a single vehicle may result in a single vehicle providing spot beams to multiple different locations. In contrast, a single larger antenna 100, such as an antenna 100 having an outer diameter in the range of from about 2.6 m to about 6 m, such as between about 4 m and about 6 m, or about 5.4 m, may provide a wide contoured beam which may target a larger region, such as a continent, larger countries, the continental United States, etc.

As described above, the hybrid reflector construction of the antennas 100 may improve the surface accuracy of the antenna 100 relative to antennas formed entirely from mesh materials while also allowing the antenna 100 to expand to a size (e.g., major dimension, diameter, etc.) greater than the maximum allowable solid antenna size for the deploying vehicle. Thus, the antennas 100 may be larger than conventional antennas, increasing the target region available while simultaneously having greater surface accuracy which may reduce the power consumption of the antenna 100.

Embodiments of the disclosure may include expandable antennas including a hybrid reflector of materials, such as a solid portion and a mesh portion. The multiple different materials in the hybrid reflector expandable antenna may provide the benefits of each material while limiting the drawbacks of each material. For example, the hybrid reflector antenna may have the lower cost and the improved reflective qualities of conventional solid antenna structures while also including the expandable and light weight features of the mesh antenna structures. This may allow lower cost, expandable antennas to be used. Furthermore, the improved reflective qualities may reduce the power consumption of the antenna assembly. For example, the hybrid reflector structures may increase the carrier signal to interference ratio of the associated antenna. The increased carrier signal to interference ratio may lead to a higher gain to noise temperature ratio and a higher or equivalent effective isotropic radiated power (EIRP) with a decrease in power consumption and a lower thermal dissipation.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. An antenna structure comprising:

a solid antenna structure;

a mesh antenna structure coupled to an outer edge of the solid antenna structure through two or more ribs, the two or more ribs configured to extend away from the solid antenna structure to expand the mesh of the antenna structure and increase a surface area of the antenna structure; and a hinge coupling the two or more ribs to the solid antenna structure, the hinge configured and positioned to rotate the two or more ribs from a position within a footprint of the solid antenna structure to a position outside of the footprint of the solid antenna structure.

2. The antenna structure of claim 1, wherein the two or more ribs have a length less than one half of a major dimension of the solid antenna structure.

3. The antenna structure of claim 1, wherein the hinge is configured and positioned to rotate the one or more ribs about the hinge relative to the solid antenna structure in a plane perpendicular to a surface plane of the solid antenna structure.

4. The antenna structure of claim 1, wherein the hinge is configured and positioned to rotate the one or more ribs about the hinge relative to the solid antenna structure in a plane substantially parallel to a surface plane of the solid antenna structure.

5. The antenna structure of claim 1, wherein the hinge includes a biasing element configured to bias each of the two or more ribs toward an expanded position.

6. The antenna structure of claim 1, wherein the mesh antenna structure comprises one or more mesh panels.

7. The antenna structure of claim 6, wherein each of the one or more mesh panels are coupled to at least two of the two or more ribs.

8. The antenna structure of claim 1, wherein the mesh antenna structure comprises a gold-plated molybdenum wire.

9. The antenna structure of claim 1, wherein the two or more ribs are configured and shaped to control a shape of the mesh antenna structure.

10. The antenna structure of claim 9, wherein the shape of the mesh antenna structure comprises a frustoconical shape.

11. An antenna cluster comprising:

at least two antennas, the at least two antennas comprising:

a solid central antenna portion; and one or more mesh portions coupled to the solid central antenna portion through two or more ribs, the two or more ribs configured to apply a tension to the one or more mesh portions in an expanded form;

wherein a distance between a center of adjacent solid central antenna portions of the at least two antennas is greater than a major dimension of the solid central antenna portions of at least one of the at least two antennas.

12. The antenna cluster of claim 11, wherein the at least two antennas are positioned such that a perimeter of the solid central antenna portion of each of the at least two antennas is configured to fit within a storage area of an associated vehicle.

13. The antenna cluster of claim 12, wherein the one or more mesh portions of the at least two antennas are configured to extend beyond the storage area of the associated vehicle in the expanded form.

14. A method of deploying an antenna assembly, the method comprising:

providing an antenna assembly in a retracted configuration, the antenna assembly comprising a solid antenna structure and mesh antenna structures coupled to the solid antenna structure;

releasing a retaining mechanism of the antenna assembly, the retaining mechanism securing two or more ribs of the mesh antenna structures to the solid antenna structure in the retracted configuration;

rotating the two or more ribs about a hinged connection from a position within a footprint of the solid antenna structure to an expanded configuration outside the footprint of the solid antenna structure; and applying tension to one or more mesh panels of the mesh antenna structures coupled between the two or more ribs when the two or more ribs rotate about the hinged connection to the expanded configuration.

15. The method of claim 14, wherein rotating the two or more ribs about the hinged connection further comprises applying a biasing force through a biasing element in the hinged connection.

16. The method of claim 15, wherein applying tension to the one or more mesh panels comprises deploying the antenna assembly to the expanded configuration where forces generated by the tension in the one or more mesh panels are substantially equivalent to the biasing force of the biasing element in the hinged connection.

17. The method of claim 14, wherein rotating the two or more ribs about the hinged connection further comprises rotating the two or more ribs in a plane substantially parallel to a plane of a surface of the solid antenna structure.

18. The method of claim 14, wherein rotating the two or more ribs about the hinged connection further comprises rotating the two or more ribs in a plane substantially perpendicular to a plane of a surface of the solid antenna structure.

* * * * *